US010178459B2

(12) United States Patent
Clark et al.

(10) Patent No.: US 10,178,459 B2
(45) Date of Patent: Jan. 8, 2019

(54) LOUDSPEAKER WITH ACOUSTIC IMPEDANCE SYSTEM

(71) Applicant: MrSpeakers, LLC, San Diego, CA (US)

(72) Inventors: Daniel William Clark, San Diego, CA (US); Robert Jason Egger, San Diego, CA (US)

(73) Assignee: MrSpeakers, LLC, San Diego, CA (US)

( * ) Notice: Subject to any disclaimer, the term of this patent is extended or adjusted under 35 U.S.C. 154(b) by 0 days.

(21) Appl. No.: 15/454,757

(22) Filed: Mar. 9, 2017

(65) Prior Publication Data

US 2017/0264996 A1 Sep. 14, 2017

Related U.S. Application Data

(60) Provisional application No. 62/305,743, filed on Mar. 9, 2016.

(51) Int. Cl.

| | |
|---|---|
| ***H04R 1/10*** | (2006.01) |
| ***H04R 3/04*** | (2006.01) |
| ***H04R 31/00*** | (2006.01) |
| *H04R 9/06* | (2006.01) |
| *H04R 19/02* | (2006.01) |
| *H04R 29/00* | (2006.01) |

(52) U.S. Cl.

CPC ..... *H04R 1/1008* (2013.01); *H04R 3/04* (2013.01); *H04R 31/00* (2013.01); *H04R 9/06* (2013.01); *H04R 19/02* (2013.01); *H04R 29/001* (2013.01); *H04R 29/003* (2013.01); *H04R 2420/07* (2013.01)

(58) Field of Classification Search

CPC ... H04R 1/2811; H04R 1/1008; H04R 1/1058
See application file for complete search history.

(56) References Cited

U.S. PATENT DOCUMENTS

| | | | | |
|---|---|---|---|---|
| 2,031,789 | A * | 2/1936 | Pierce | H04R 15/00 318/118 |
| 3,883,841 | A | 5/1975 | Norel et al. | |
| 4,333,028 | A | 6/1982 | Panton | |
| 5,373,268 | A | 12/1994 | Dworsky et al. | |
| 5,646,583 | A | 7/1997 | Seabury et al. | |
| 6,200,266 | B1 | 3/2001 | Shokrollahi et al. | |
| 6,307,447 | B1 | 10/2001 | Barber et al. | |
| 6,452,310 | B1 | 9/2002 | Panasik | |
| 6,542,054 | B2 | 4/2003 | Aigner et al. | |
| 7,296,329 | B1 | 11/2007 | Barber et al. | |
| 7,701,117 | B2 | 4/2010 | Nakatsuka et al. | |
| 7,853,034 | B1 * | 12/2010 | Gresko | H04R 5/033 381/370 |
| 2013/0287232 | A1 * | 10/2013 | Polster | H04R 17/005 381/190 |

* cited by examiner

*Primary Examiner* — Tuan D Nguyen
(74) *Attorney, Agent, or Firm* — Hall Estill Attorneys at Law; Tyler J. Mantooth

(57) ABSTRACT

A loudspeaker assembly may be configured with at least one driver disposed between first and second acoustic impedance structures. The first and second impedance structures can be arranged with one or more layers that have similar, or dissimilar, thicknesses. The first and second impedance structures can respectively be configured to maintain symmetric acoustic impedance on opposite sides of the driver during operation of the driver.

18 Claims, 4 Drawing Sheets

150

LOUDSPEAKER WITH ACOUSTIC IMPEDANCE SYSTEM

RELATED APPLICATION

The present application makes a claim of domestic priority to U.S. Provisional Patent Application No. 62/305,743 filed Mar. 9, 2016, the contents of which are hereby incorporated by reference.

SUMMARY

A loudspeaker assembly, in accordance with some embodiments, has a planar magnetic or electrostatic driver disposed between first and second acoustic impedance structures. The first and second impedance structures each having one or more layers that are tuned to maintain a symmetric acoustic impedance on opposite sides of the driver during operation of the driver.

DETAILED DESCRIPTION

Traditional theory about loudspeakers and headphones assumes that materials between a driver and a user should be kept to a minimum to minimize loss of musical information. While some loudspeakers position at least one damper proximal to the rear side of a planar or electrostatic driver, such components are treated as filters to shape the frequency response of the system. However, they cannot fully optimize the time domain performance of the system, such as the driver's Q factor, because they are not designed to balance the acoustic impedance presented to both sides of the driver, which results in higher harmonic distortion and degraded impulse response. Hence, various embodiments are directed to structures positioned proximal to a loudspeaker driver to optimize the acoustic impedance of the driver by controlling and balancing the load experienced on opposite sides of the driver to optimize system Q, reduce total harmonic distortion (THD), and improve transient response.

In the past, placement of structures and materials between a loudspeaker driver and a user's ear has been discouraged due to the assumption that such structures introduce entropy and filtering effects to the movement of air by the driver that reduce the potential of the driver to produce maximum acoustic detail. Although thin materials, such as speaker grill cloth, can contribute to what a user hears by filtering certain frequencies, the material and design of such structures are not conducive to increased driver performance because they are designed for minimal acoustic interaction with the driver and serve as cosmetic treatments, or mechanical protection for the driver.

Conventional wisdom holds there should be as little material as possible between a driver and a listener due, at least in part, to the assumed intrinsic entropic effects of acoustically permeable media, such as fabrics, felts, and foams. That is, the fibers, cells, and other aspects of the acoustically permeable media, cause acoustic signals to follow diffuse paths of various lengths, which serve to randomize the pressure waves of low level signals and cause a loss of perceived detail to the listener. For these reasons, dampening material is typically only placed on the side of a driver facing away from a listener. While this single-ended approach to loading the driver may serve to provide some improvement in time domain performance, the load is by definition asymmetric, which may introduce various forms of audible distortion.

Figure 1:
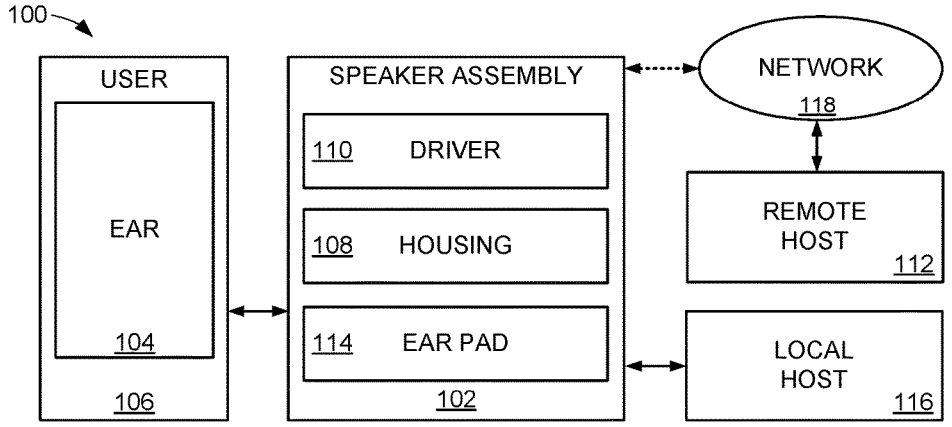
FIG. 1 is a block representation of an example audio system arranged in accordance with various embodiments.

FIG. 1 is a block representation of an example acoustic system 100 that may employ one or more loudspeakers in accordance with some embodiments. As shown, a speaker assembly 102 communicates with an ear 104 of a user 106. It is noted, but not required, that multiple different speaker assemblies 102 can be concurrently or individually used in conjunction with one or more ears 104 of the user 106. It is also noted that the speaker assembly 102 can configured with a housing 108 that facilitates a position in, on, or adjacent to the user's ear 104.

The speaker assembly 102 can have any number and type of drivers 110 that operate individually and/or concurrently to translate a signal from a remote host 112, such as a controller, portable amplifier, or desktop amplifier, into audible acoustic frequencies. The speaker assembly 102 may engage the user's ear 104 with an ear pad 114. It is contemplated the ear pad 114 rests on the periphery of the user's ear 104, surrounds the ear 104, or, in the case of in-ear monitors, engage the ear canal of the ear 104. Regardless of the position of the ear pad 114, the ear pad 114 may be constructed of materials that provide comfort and practical acoustic performance.

The speaker assembly 102 can be electrically connected to the local host 116 via any number of wired and/or wireless protocol. The local host 116 may be any kind of microprocessor and chipset with any computing capabilities and may also include a power amplifier. In some embodiments, the local host 116 is positioned within the speaker assembly housing 108 while other embodiments position the local host 116 away from the user's ear 104.

The local host 116 can operate with one or more remote hosts 112 via a wired or wireless network 118, which provides increased computing capabilities beyond that of the local controller. For example, a remote host 112 may be an additional processor that supplements the local host 116 or a second remote host 112 may be a cloud-based node that provides access to software, memory, and processing capabilities. A wireless network 118 configuration also allows multiple speaker assemblies 102 to be musically connected wirelessly, such as through Bluetooth protocol.

Figure 2:
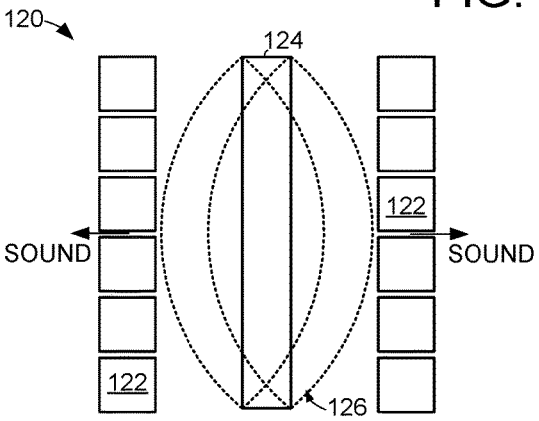
FIG. 2 shows a line representation of a portion of an example planar magnetic loudspeaker capable of being used in the audio system of FIG. 1.

FIG. 2 displays a block representation of a portion of an example planar magnetic, or electrostatic, loudspeaker 120, which is hereafter characterizes as a planar loudspeaker, organized in accordance with some embodiments. In planar magnetic design, air is moved through one or more metal structures, perforated metal sheets, arrays, or trays of magnets 122 into a cavity defining a volume between the membrane 124 and a user's ear. A headphone implementation of a planar magnetic driver with a closed or vented housing away from the user's ear results in the mass of air moved by the membrane 124 causing an asymmetric pressure gradient across the membrane 124, which degrades the total harmonic distortion (THD) of the driver 120. It is noted that asymmetric pressure is meant as a difference in air mass and/or pressure on opposite sides of the membrane 124 caused by asymmetry in volume or materials within the volume on both sides of the membrane 124 that result in asymmetric damping of the driver.

While it is acknowledged that movement of the membrane 124, as shown by segmented lines 126, will inherently create a temporary pressure differential depending on the direction of membrane 124 travel, having heterogenous loads on either side of the membrane 124 will affect the system's transient response negatively. Thus, the incorporation of acoustic impedance balancing structures in accordance with various embodiments can more quickly and efficiently equalize air pressure to create a symmetric air pressure condition about the membrane 124 than simple, single-ended dampers.

It is to be understood that the term acoustic impedance is meant as resistance to air flow. Technically, assorted references to acoustic impedance are to be understood as specific acoustic impedance, which is the ratio of acoustic pressure to specific flow where acoustic pressure refers to the oscillation of at least one component. Thus, the pressure of air compared to the velocity of air in a loudspeaker is the acoustic impedance of the loudspeaker. It is noted that with some loudspeaker drivers, such as planar magnetic or electrostatic structures, there will be multiple acoustic impedance values, one for each side air is moved by the driver.

As a non-limiting analogy, if acoustic impedance is linear with frequency, it is equivalent to a resistor in a circuit or a shock absorber in an automobile. Hence, the air in a user's ear cavity would act as a spring in an automobile suspension and energy can be stored in the ear cavity before dissipating via absorption by the user's ear drum, air leakage, or some other energy transfer.

By tuning one or more acoustic impedance structures, various embodiments add resistance to the airflow in a loudspeaker to create pressure on the driver that loads the membrane 124, which increases the damping on the driver and reduces the propensity of the membrane 124 to oscillate and produce distorted sound. Further, adding resistance to the standing air column in a loudspeaker with at least one acoustic impedance structure reduces the tendency of air to oscillate in an undamped closed air volume and form standing waves, thereby improving the linearity of the loudspeaker.

In some embodiments, an acoustic impedance structure comprises an acoustic open cell foam material that has substantially linear resistance for various pressures. Meanwhile, wool, felt, or other materials can provide either a primary, or a series secondary, acoustic impedance structure with strong filtering effects that are not only entropic, but provide a filter with a pole in the audible spectrum.

For instance, movement of the membrane 124 can generate pressure within an enclosed housing that limits the operation, which effectively compresses air on one side and creates a vacuum on the opposite side. To the extent these forces are asymmetric, the driver response becomes less predictable, introduces nonlinearities in the response to input signals, and potentially degrades transient membrane 124 response as the asymmetric loads can induce oscillations on the membrane 124 that result sound quality being below the potential of the driver 120. Such divergent pressure regions on opposite sides of the membrane 124 can be particularly detrimental to planar driver operation where the membrane 124 is very lightweight and easily influenced by differences in air mass, flow, and pressure. Accordingly, various embodiments are directed to acoustic impedance structures that promote symmetric air pressure on opposite sides of the driver.

Figure 3:
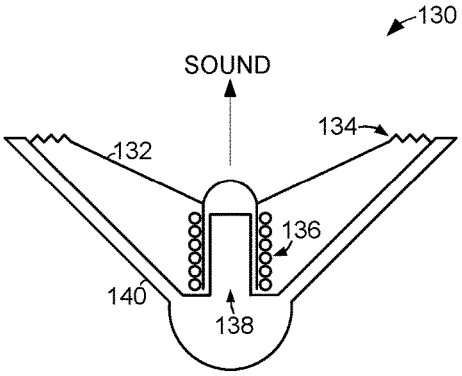
FIG. 3 provides a line representation of a portion of an example loudspeaker that may be employed in the audio system of FIG. 1.

In contrast to the planar magnetic driver 120, a loudspeaker may employ a dynamic driver 130, as displayed by the cross-section line representation of FIG. 3. The dynamic driver 130 moves air and creates sound waves via a speaker cone 132 that is not nearly as susceptible to differences in air pressures due to the robustness of the diaphragm's suspension 134 and the relative increase in driver mass relative to the effective mass of the air load on both sides of the speaker cone 132. The suspension 134 can be less vulnerable to ambient air pressures than a planar magnetic membrane 122 due, at least in part, to the suspension 134 operating in concert with a voice coil 136 and magnetic pole 138 portion of a frame 140 to move and generate sound frequencies in response to signal(s) passing through the voice coil 136.

Figure 4:
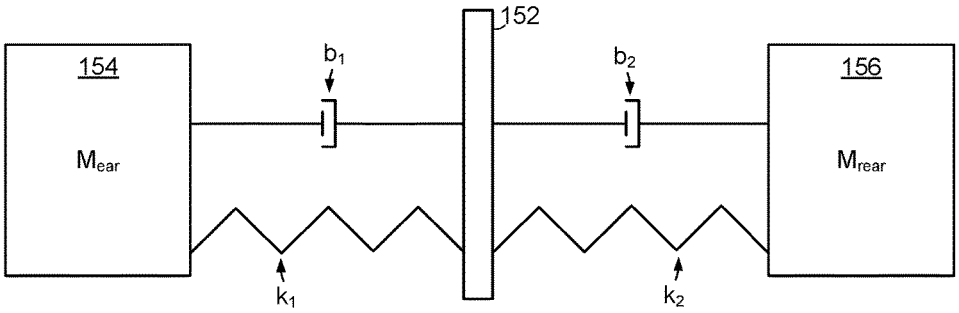
FIG. 4 displays a block representation of a model acoustic system arranged in accordance with various embodiments.

FIG. 4 is a line representation of a model acoustic system 150 that illustrates example structural and operational considerations for assorted embodiments. The acoustic system 150 positions a sound producing structure 152, such as membrane 124 of FIG. 2 or speaker cone 132 of FIG. 3, between a user's ear 154 and a rear region 156 positioned distal to the user's ear 154. It is noted that the user's ear 154 and rear region 156 can each comprise a volume of air in and around the respective areas. The driver 154 acts upon $M_{ear}$, which is to a first order approximation of the sum of the air mass proximal to the driver and mass of the user's ear drum. As air is a compressible and lossy medium, it has elements $k_1$ and $b_1$ hat dissipate energy stored within an enclosed space. To the sound producing structure 152, the $M_{ear}$ occupies space proximal the cavity of the ear and the moving mass of the ear drum.

Similarly, the rear region 156 can consist of the mass of air bounded by the cavity of a housing, such as a closed or vented rigid headphone cup, positioned behind the sound producing structure 152, or in the case of an "open-back" headphone, the effective air mass is set in motion by the rear-side of the sound producing structure 152. It is worth noting that in the case where $M_{rear}$ is not enclosed, but instead open, $M_{rear}$ is not infinite due to compressibility of air, which can be approximated as a fixed mass with a constant spring force ($k_2$) and damping force ($b_2$).

The material, size, suspension, and operating load of the sound producing structure 152 acts on $M_{ear}$ and $M_{rear}$ in a manner that is affected by forward ($k_1$, $b_1$) and rearward ($k_2$, $b_2$) operating properties. For example, a driver membrane may encounter different characteristics moving forward ($k_1$, $b_1$) than moving rearward ($k_2$, $b_2$) as a result of any structural configurations that may be asymmetric, such as grills, magnets, or other obstructions impacting the specific acoustic impedance as seen by the sound producing structure 152.

When conventional damper materials are positioned between the rear region 156 and sound producing structure 152, the rearward operating properties ($b_2$ and $k_2$) can be altered at some, or all, operating frequencies. For instance, a damper material may inhibit air flow in the rear region 156, which can affect the frequency and time domain performance of the sound producing structure 152. This is common practice in loudspeaker design, and to a lesser extent in dynamic headphone design. However, such configuration can create asymmetry in the driver loading, which can degrade performance.

Thus, various embodiments position acoustic impedance structure(s) on opposite sides of the sound producing structure 152 to tune the operating properties ($b_1$, $k_1$, $b_2$, & $k_2$) of the structure 152 with the masses $M_{ear}$ and $M_{rear}$ to optimize sound production. In other words, the behavior of air ($b_1$, $k_1$, $b_2$, & $k_2$) on opposite sides of the sound producing structure 152 are manipulated through addition of low-entropy materials that increase the values of b and k to create a symmetric load on the driver.

Figure 5:
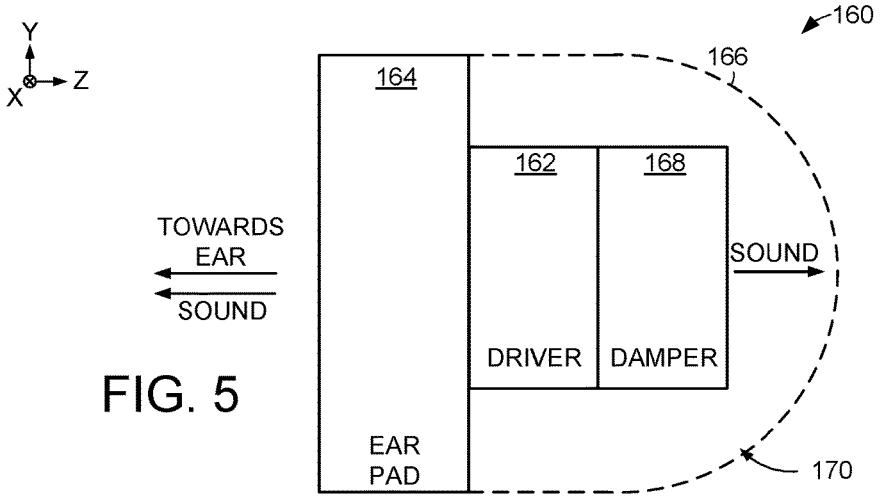
FIG. 5 illustrates a cross-sectional line representation of a portion of an example speaker assembly configured in accordance with some embodiments.

FIG. 5 provides a block representation of a portion of an example headphone speaker assembly 160 that positions a driver 162 between an ear pad 164 and a damper 166. The driver 162 may by any type or size and may consist of multiple similar, or dissimilar sound producing structures. The ear pad 164 may, or may not, contact the driver 162 and be configured to engage a user, such as in, on, or around the user's ear. The ear pad 164 may be constructed of any number of materials, but is combination of a pliable surface material with internal foam in some embodiments with an acoustically transparent region, such as a cutout, that is aligned with the driver 162 to allow sound to pass unimpeded to a user's ear.

In an "open" headphone where the housing 166 is absent, one or more dampers 168 can be positioned at the rear surface of the driver 162, away from the user's ear, to increase the rear load on the driver in either bandpass or stopband mode, depending on the material of the damper 166. So long as specific acoustic impedance of the system defined by $M_{ear}$ and ($k_1$, $b_1$) is greater than that defined by $M_{rear}$ and ($k_2$, $b_2$) this works. The effects of a damper 166 can be further complicated in the cavity 170 enclosed by the housing 166 that may be partially or completely filled with material that scatters air flow, such as fiberglass or fabric that modify ($k_2$, $b_2$).

However, in many instances motor structure, ear pad design, or the inclusion of a closed-cup cavity 170, can create a situation where specific acoustic impedance of $M_{rear}$ and ($k_2$, $b_2$) is greater than that defined by $M_{ear}$ and ($k_1$, $b_1$). In this instance, modification of the system to increase the specific acoustic impedance of the system defined by $M_{ear}$ and ($k_1$, $b_1$) is required to achieve balanced loads on the driver 162. The result of asymmetric loading of the driver 162 due to asymmetric specific acoustic impedance on opposite sides of the sound producing structure of the driver 162 can include distortions, such as, but not limited to, exciting irregular oscillations on the surface of planar drivers, which degrades system linearity and resolution.

Figure 6:
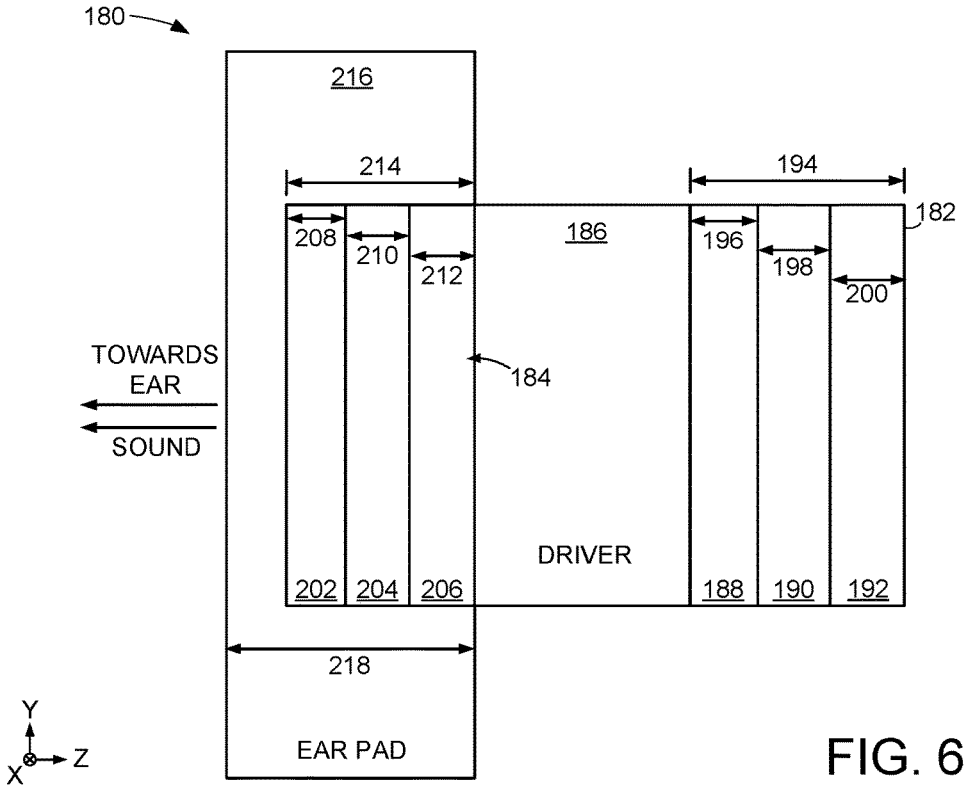
FIG. 6 is a cross-sectional line representation of a portion of an example speaker assembly constructed and operated in accordance with assorted embodiments.

FIG. 6 displays a line representation of a portion of an example speaker assembly 180 arranged in accordance with some embodiments to position acoustic impedance structures 182 and 184 proximal opposite sides of a driver 186, such as a planar magnetic or electrostatic driver. The first acoustic impedance structure 182 can be positioned in contact with, or separated from, the driver 186 on the opposite side of the driver 186 from the user's ear. While not limiting or required, the first acoustic impedance structure 182 is constructed of a layering of first 188, second 190, and third 192 layers that provide an overall first width 194 along the Z axis. The order of layering may be specific, or random, depending on the properties of the materials in question.

The first 182 and second 184 acoustic impedance structures can be independently configured to match, or be different, so that the acoustic impedance experienced by a driver 186 is tuned to optimize driver 186 operation. It is contemplated that the acoustic impedance structures 182 and 184 can promote symmetric or asymmetric air pressure and/or specific acoustic impedance on the driver 186 with heterogeneous materials in assorted arrangements.

Regardless of the configuration of individual acoustic impedance structures 182 or 184, the collective structures operate to provide a symmetric load on the driver 156 that reduces potential non-linearity in driver motion, which lowers the overall THD of the speaker assembly 180 while improving linearity. The tuned acoustic impedance structures 182 and 184 further provide control of the time domain performance of the driver 186. In effect, the configuration of the respective acoustic impedance structures 182 and 184 improves system damping and acoustic performance. For example, unwanted ringing in the time domain can occur, which can be a common acoustic result of asymmetric acoustic impedance in planar magnetic drivers. Such ringing can be a significantly higher-order distortion than losses in signal caused by entropic properties, such as simple frequency filter dampers.

By reducing high-order distortion by tuning the respective acoustic impedance structures 182 and 184, the use of additional frequency filters can increase resolution and acoustic detail that outweighs the potential adverse effects of entropic loss through damping materials on low-level signals. As shown, the first 182 and second 184 acoustic impedance structures are each laminations of different layers of acoustically permeable material that collectively allow detailed acoustic signals to pass while promoting an acoustic impedance balance on opposite sides of the driver 186 that results in a symmetric load on the sound wave generating means of the driver 186.

The respective layers of the first acoustic impedance structure 182 can be different, or similar, materials with thicknesses 196, 198, and 200 that control the air load around the rear portion of the driver 186. The second acoustic impedance structure 184 is also configured as a lamination of first 202, second 204, and third 206 layers that respectively have first 208, second 210, and third 212 thicknesses that collectively form a second overall thickness 214. The configuration of the various layers, 202, 204, and 206 increase the values of $b_1$ and $k_1$ to increase the load on the driver to complement, or balance, with $M_{rear}$, $b_2$, and $k_2$. Hence, material and thickness selection for layers 188, 190, 192, 202, 204, and 206, such as thicknesses of 1.5 mm or more, airflow of a specified CFM, or filtration values of 50 micron or less, can increase the specific acoustic impedance of the system.

The ability to tune the materials, thicknesses, and number of layers for the respective first 182 and second 184 acoustic impedance structures provides controlled damping that provides symmetric acoustic impedance across the driver 186 during operation. That is, the acoustic impedance structures 182 and 184 can be configured similarly, or dissimilarly, to optimize driver 186 operation by damping air movement to provide matching air pressures on opposite sides of the sound producing structure of the driver 186. As a non-limiting example, the first acoustic impedance structure 182 can be constructed with different materials, constituent layer thicknesses, and overall thickness 194 compared to the second acoustic impedance structure 184 so that a symmetric air load is maintained on opposite sides of the driver 186 before, during, and after driver 186 operation. It is contemplated that the acoustic impedance structures 182 and/or 184 may be constructed with multiple poles to create complex frequency-dependent acoustic filters.

It is noted that the number, type, and position of the driver 186 as well as the shape and style of the speaker assembly housing can dictate the number of acoustic impedance structure layers, layer materials, and layer thicknesses to ensure the driver 186 operates with minimal air mass influence. In other words, the specific acoustic impedance structures 182 and 184 can be tuned in response to the assembled speaker assembly 180 to reduce, or eliminate, areas of high, or low frequencies inhibiting the natural response of the sound producing structure of the driver 186.

As shown, the second acoustic impedance structure 184 continuously extends into the ear pad 216, but such configuration does not mandate that the ear pad material is positioned between the user's ear and the driver 186. For instance, the ear pad 216 can encircle the second acoustic impedance structure 184 without positioning ear pad material in the path of sounds generated from the driver 186. However, the ear pad 216 may, in some embodiments, be positioned between the user's ear and the second acoustic impedance structure 184 to contribute to the control of the air load experienced on the ear-side of the driver 186. Further, the second acoustic impedance structure 184 is not required to cover the entire surface of the driver 186, or may be composed of multiple discrete elements in isolation, or as part of a complex pattern, or array, with partial or complete coverage of the driver 186.

It is contemplated that the various acoustic impedance structure layers can be constructed of any material with similar, or dissimilar, sizes and thicknesses. Materials like, but not limited to, polyester, open-cell foam, urethane, rubber, ceramics, 3D printed arrays, felts, wool, and plastic, such as nylon, can be individually and collectively be used for the respective layers of the acoustic impedance structures 182 and 184. The ability to utilize different materials for the assorted layers of the impedance structures 182 and 184 allows air flow and air mass to be controlled so that operation of the driver 186 is optimized. It is noted that structures 182 and 184 may be utilized individually (single pole) and collectively (multiple pole) in accordance with various embodiments.

It can be appreciated that tuning the acoustic impedance structures 182 and 184 positioned on opposite sides of the driver 186 can be particularly important in planar magnetic and electrostatic driver arrangements where the sound producing membrane moves towards, and away from, the user's ear and whose load may be close to $M_{ear}$ and/or $M_{rear}$. As such, the configurations of the ear-facing second acoustic impedance structure 184 and the rear-facing first acoustic impedance structure 182 can be different to accommodate the volume of air in the ear cavity versus the volume of air in the rear portion of the speaker assembly 180 to provide symmetric, or specific asymmetric, air load and pressure on the driver during operation.

Figure 7A:
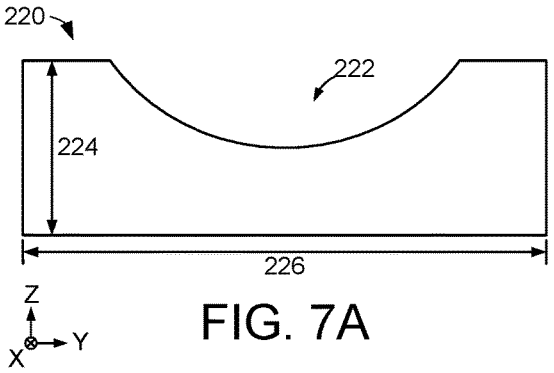
FIGS. 7A & 7B respectively depict line representations of different portions of an example acoustic impedance structure layer.
Figure 7B:
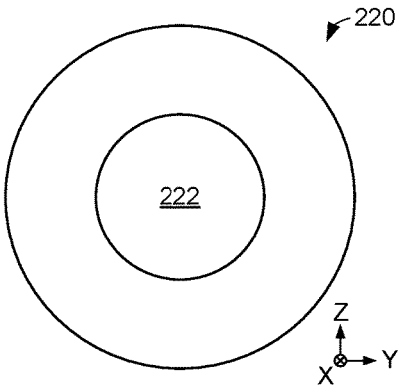

Although the material and thickness of the respective impedance structure layers can provide customized air flow control, the assorted layers may also be tuned with respect to shape. FIGS. 7A and 7B respectively display cross-sectional and top line representations of an example impedance structure layer 220 that may be incorporated into one, or more, acoustic impedance structures in a speaker assembly. The cross-sectional profile of FIG. 7A illustrates how the layer 220 has a non-uniform thickness that is defined by a continuously curvilinear notch 222 that alters the thickness 224 of the layer 220 throughout a portion of the layer's width 226.

The top view of FIG. 7B shows how the notch 222 is aligned along a center of an overall circular shaped layer 220. While the notch 222 extends to less than the entirety of the circular shape, such arrangement is not required as any number of notches can be positioned to occupy any region of the layer 220. For example, the notch 222 may continuously extend along the entire width 226 of the layer 220. It is noted that the circular shape of the notch 222 and layer 220 may be tuned to be elliptical or some other shape having linear and/or curvilinear shaped boundaries.

Figure 8A:
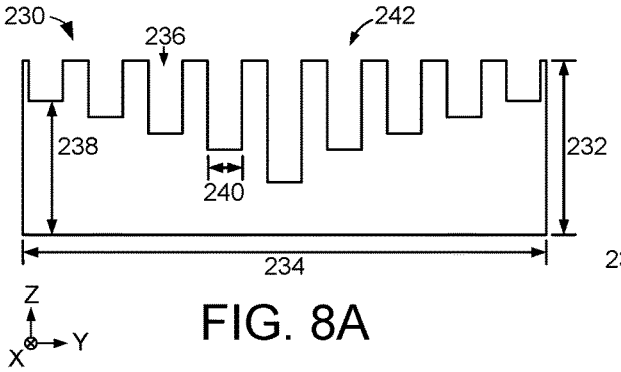
FIGS. 8A & 8B respectively show line representations of different portions of an example acoustic impedance structure layer.
Figure 8B:
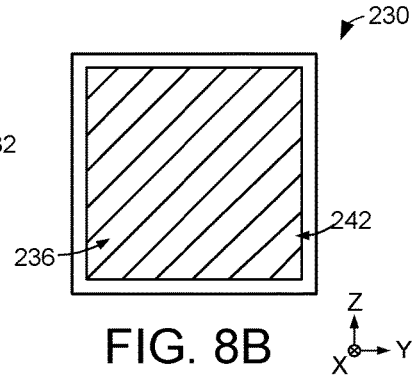

The cross-sectional and top view line representations of FIGS. 8A and 8B respectively convey an example impedance structure layer 230 that can be employed alone, or in combination with other layers, in a speaker assembly. FIG. 8A shows how the layer 230 has an overall thickness 232 and width 234. A number of separate recesses 236 respectively extend to provide a reduced layer thickness 238. It is contemplated that the various recesses 236 can have different depths and/or widths 240. The example embodiment shown in FIG. 8A reflects a gradually greater recess depth towards the center of the layer width 234, but such configuration can be changed to customize how air mass and pressure pass through the layer 230, which controls the load applied to an adjacent driver. The pattern shown in FIG. 8A can create "micro-variations" in air pressure due to its proximity to the planar driver surface that can, in turn, act as a buffer to reduce the driver's propensity to oscillate and "break up" on the driver surface.

The top view of FIG. 8B illustrates how the layer 230 can have an overall rectangular shape. For instance, the layer 230 may be square and the plurality of recesses 242 continuously extend across less than all of the layer's width 234 to provide a rectangular, or square, shaped region. It is noted that the recesses 236 are each oriented diagonally with respect to the Z axis. Such configuration can provide another customizable aspect of the layer 230 that can control the air mass, flow, and pressure experienced by a driver.

Figure 9A:
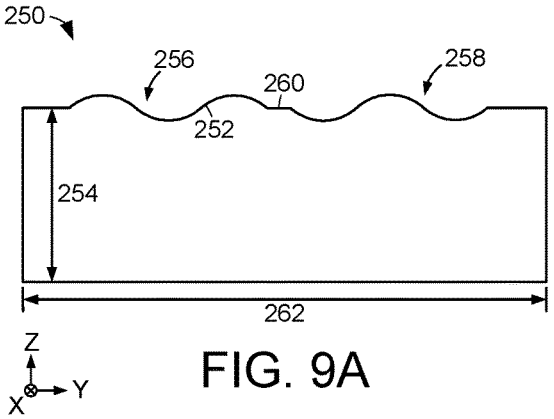
FIGS. 9A & 9B respectively display line representations of different portions of an example acoustic impedance structure layer.
Figure 9B:
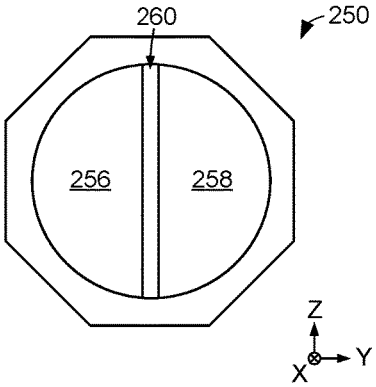

With layers 220 and 230, portions of the respective thicknesses 224 and 232 were removed. FIGS. 9A and 9B display cross-sectional and top view line representations of an example impedance structure layer 250 that employs a plurality of protrusions 252 that extend the layer's overall thickness 254. The cross-sectional view of FIG. 9A shows how the protrusions 252 are continuously curvilinear and connected to form first 256 and second 258 groupings. A linear surface 260 separates the groupings 256 and 258, but is not required as the protrusions 252 can continuously extend along any portion of the layer's width 262.

In some embodiments, a protrusion 252 is wholly, or partially, defined by a linear boundary that configures at least one protrusion 252 with a triangular or rhomboid shape. FIG. 9B shows how the layer 250 can have an overall octagon shape, but such configuration is not limiting as other parallelogram shapes are possible. The top view of FIG. 9B further shows how the protrusion groupings each have an overall semi-circular configuration with the linear surface 260 bifurcating the layer 250 along its center point. It is noted that any aspect of the layers of FIGS. 7A-9B can be utilized individually and collectively to customize an acoustic impedance structure. The ability to employ different materials along with different layer shapes, protrusions, recesses, and notches provides a diverse arsenal of impedance structure features that can optimize air mass, flow, and pressure in a speaker assembly.

Figure 10:
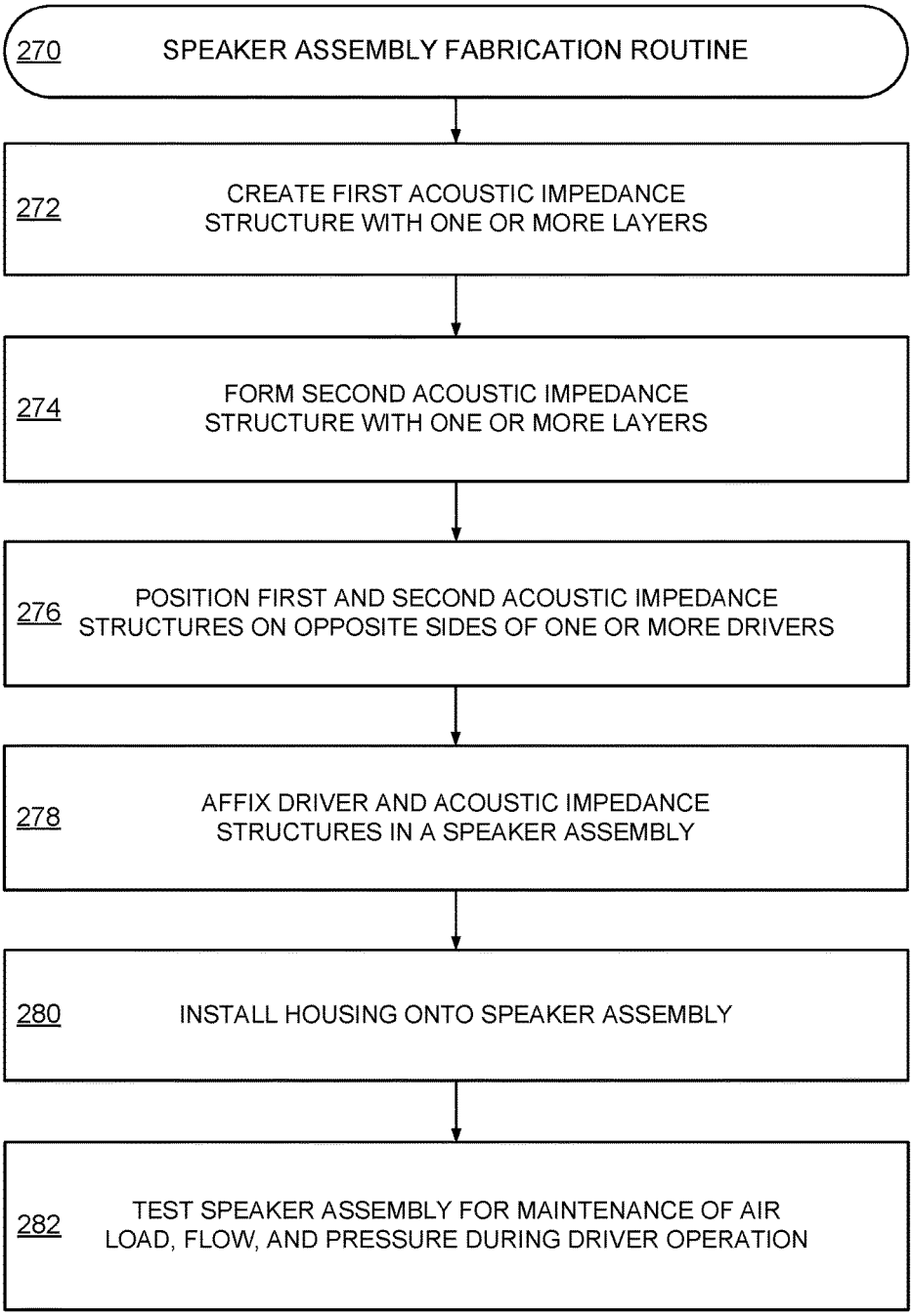
FIG. 10 provides an example speaker assembly fabrication routine carried out in accordance with assorted embodiments.

FIG. 10 is a flowchart of an example speaker assembly fabrication routine 270 that may be carried out in accordance with assorted embodiments. The fabrication routine 270 can begin in step 272 by creating a first acoustic impedance structure with one or more layers. For example, one or more differently configured layers may be created in step 272 with different thicknesses, materials, overall shapes, protrusions, notches, recesses, and sizes that are affixed together, or are separated by an air buffer, to provide a laminated impedance structure. A second acoustic impedance structure is formed in step 274 with one or more layers. In some embodiments, the second acoustic impedance structure has one or more differently configured layers that may, or may not, match the constituent layers of the first acoustic impedance structure.

Next, step 276 positions the first and second acoustic impedance structures on opposite sides of at least one driver, such as a planar magnetic driver. It is contemplated that the impedance structures may continuously extend across multiple separate drivers. The positioning of the acoustic impedance structures may involve contact with, or separation from, the driver with the structures aligned along a center of the driver. It is noted that the sequence of steps 272, 274, and 276 are not limited to that shown in FIG. 10. As such, the respective acoustic impedance structures can be created, positioned, and tuned at any time prior to step 278 affixing the assembled driver and acoustic impedance structures in a speaker assembly.

A housing is subsequently installed in step 280 that can enclose, support, and/or be positioned proximal to the driver and acoustic impedance structure(s). The result of the assembly of driver and acoustic impedance structures in the speaker assembly can be a closed, vented, or open loudspeaker that may be used as a headphone with the addition of an ear-engaging pad. The routine 270 proceeds to test the speaker assembly for symmetric, or asymmetric, air load, flow, and pressure during operation of the driver in step 282. It is noted that the various aspects of routine 270 are not limited or required and any portion can be changed or removed just as any step or decision can be added.

It is to be understood that even though numerous characteristics and configurations of various embodiments of the present disclosure have been set forth in the foregoing description, together with details of the structure and function of various embodiments, this detailed description is illustrative only, and changes may be made in detail, especially in matters of structure and arrangements of parts within the principles of the present disclosure to the full extent indicated by the broad general meaning of the terms in which the appended claims are expressed. For example, the particular elements may vary depending on the particular application without departing from the spirit and scope of the present technology.

What is claimed is:

1. An apparatus comprising: a planar magnetic driver; a first acoustic impedance structure contacting a first side of the planar magnetic driver; and a second acoustic impedance structure contacting a second side of the planar magnetic driver, at least one of the first and second impedance structures comprising at least two layers with different materials, the first and second impedance structures being different to maintain a symmetric acoustic impedance on opposite sides of the driver during operation.

2. The apparatus of claim 1, wherein the first impedance structure is different than the second impedance structure.

3. The apparatus of claim 1, wherein the first acoustic impedance structure comprises a first layer contacting second and third layers.

4. The apparatus of claim 3, wherein the second acoustic impedance structure comprises a fourth layer contacting fifth and sixth layers.

5. The apparatus of claim 1, wherein the first acoustic impedance structure extends from the planar magnetic driver into an ear pad.

6. The apparatus of claim 1, wherein the first acoustic impedance structure comprises a fabric or open-cell foam.

7. The apparatus of claim 1, wherein the first and second acoustic impedance structures are different thicknesses, each thickness measured parallel to a direction from the planar magnetic driver to a user's ear.

8. The apparatus of claim 7, wherein the thickness of the first acoustic impedance structure is 2 mm or more and the thickness of the second acoustic impedance structure is 1.5 mm or more.

9. The apparatus of claim 1, wherein the first acoustic impedance structure has a filtration rating of 100 microns or less.

10. The apparatus of claim 1, wherein a first layer of the first acoustic impedance structure has a variable thickness defined by a notch.

11. The apparatus of claim 1, wherein a first layer of the first acoustic impedance structure has a variable thickness defined by a plurality of recesses.

12. The apparatus of claim 11, wherein the plurality of recesses extend to less than an entirety of a width of the first layer.

13. The apparatus of claim 11, wherein the plurality of recesses extend different depths into the first layer, a first recess of the plurality of recesses having a largest depth of the plurality of recesses aligned with a center point of the planar magnetic driver.

14. The apparatus of claim 1, wherein a first layer of the first acoustic impedance structure has a variable thickness defined by at least one protrusion.

15. The apparatus of claim 1, wherein a first layer of the first acoustic impedance structure has a different shape than a second layer of the first acoustic impedance structure.

16. The apparatus of claim 1, wherein a first layer of the first acoustic impedance structure has first and second regions configured with different variable thicknesses.

17. A method comprising: configuring a first acoustic impedance structure with two or more layers of different materials, the first acoustic impedance structure contacting a first side of a planar magnetic driver; creating a second acoustic impedance structure with two or more layers of different materials, the second acoustic impedance structure contacting a second side of the planar magnetic driver; positioning a driver between the first and second acoustic impedance structures the first and second impedance structures the first and second impedance structures being different; maintaining symmetric first and second acoustic impedances on respective first and second sides of the planar magnetic driver during operation of the planar magnetic driver.

18. The method of claim 17, wherein the first and second acoustic impedances correspond with a common air load on opposite sides of the planar magnetic driver.

* * * * *